United States Patent [19]

Sweat, Jr.

[11] 4,178,907

[45] Dec. 18, 1979

[54] UNIFIED HOT WATER AND FORCED AIR HEATING SYSTEM

[76] Inventor: James R. Sweat, Jr., 2284 Heritage Dr., San Jose, Calif. 95124

[21] Appl. No.: 928,366

[22] Filed: Jul. 27, 1978

[51] Int. Cl.[2] ..... F24D 9/00; F24H 1/22

[52] U.S. Cl. ..... 126/101; 122/20 B; 122/33; 165/DIG. 2; 237/8 R; 237/19; 237/55

[58] Field of Search ..... 126/101; 122/20 B, 33; 165/DIG. 2; 237/8 R, 19, 55

[56] References Cited

U.S. PATENT DOCUMENTS

| | | | |
|---|---|---|---|
| 2,373,731 | 4/1945 | Wilson | 237/19 |
| 2,497,184 | 2/1950 | O'Brien | 126/101 |
| 2,789,769 | 4/1957 | Dalin | 237/19 |
| 2,827,893 | 3/1958 | Ribaudo et al. | 126/101 |
| 3,198,190 | 8/1965 | Gordon | 126/101 |
| 3,833,170 | 9/1974 | Marshall | 126/101 |
| 3,896,992 | 7/1975 | Borovina | 237/19 |
| 3,999,709 | 12/1976 | Estabrook | 237/8 R |
| 4,037,786 | 7/1977 | Munroe | 237/19 |
| 4,044,950 | 8/1977 | Engeling | 237/55 |
| 4,066,210 | 1/1978 | Pemberton | 165/DIG. 2 |

*Primary Examiner*—Samuel Scott

*Assistant Examiner*—Daniel J. O'Connor

*Attorney, Agent, or Firm*—Thomas Schneck, Jr.

[57] ABSTRACT

A water heating and forced air heating system that provides potable hot water and that also provides heated air for heating enclosed spaces within buildings, including: a water heater including a water tank filled with water, a burner for heating the water in the tank, and an exhaust flue for removing hot gases generated by the burner; a gas-to-liquid heat exchange unit disposed within the flue; a forced air heater having a casing that defines a chamber, a liquid-to-gas heat exchange unit disposed within the chamber, a gas-to-gas heat exchange unit also disposed within the chamber, and a blower for pulling fresh air into the chamber and blowing it past the heat exchange units to absorb heat; a pump for pumping water through the gas-to-liquid heat exchange unit so that the water becomes heated by the hot gases within the flue; another pump for pumping heated water through the liquid-to-gas heat exchange unit to heat the air flowing within the chamber; and a conduit for connecting the terminal end of the flue to the gas-to-gas heat exchange unit in order to further heat the air flowing through the chamber.

12 Claims, 4 Drawing Figures

| SYMBOL LEGEND |
| --- |
| $\bar{F}$-FAUCET 94 CLOSED |
| F-FAUCET 94 OPEN |
| $\bar{S}$-SWITCH 138 OPEN |
| S-SWITCH 138 CLOSED |
| $\bar{T}$-THERMOSTATE 124 OPEN |
| T-THERMOSTATE 124 CLOSED |
| P1-PUMP |
| P2-PUMP |
| M-MOTOR |

| | P1 | P2 | M | AIR AND WATER FLOW |
|---|---|---|---|---|
| $\bar{F}\bar{S}\bar{T}$ | OFF | OFF | OFF | NO AIR FLOW THROUGH AIR HEATER. NO WATER FLOW AT ALL. |
| $\bar{F}\bar{S}T$ | OFF | ON | ON | AIR FLOW THROUGH AIR HEATER. WATER IS DRAWN FROM TANK, CIRCULATED THROUGH HEAT EXCHANGER 60 AND RETURNED TO TANK. |
| $\bar{F}S\bar{T}$ | ON | OFF | OFF | NO AIR FLOW IN AIR HEATER. WATER IS DRAWN FROM TANK, CIRCULATED THROUGH HEAT EXCHANGER 14 AND RETURNED TO TANK. |
| $\bar{F}ST$ | ON | ON | ON | AIR FLOW THROUGH AIR HEATER. WATER FLOWS BOTH THROUGH HEAT EXCHANGERS 14 AND 60. |
| $F\bar{S}\bar{T}$ | OFF | OFF | OFF | NO AIR FLOW THROUGH AIR HEATER. WATER FLOWS INTO WATER HEATER FROM PIPE 92 AND OUT OF WATER HEATER THROUGH FAUCET 94. |
| $F\bar{S}T$ | OFF | ON | ON | AIR FLOWS THROUGH AIR HEATER. WATER FLOWS FROM WATER HEATER TANK THROUGH HEAT EXCHANGER 60 AND BACK INTO TANK AND ALSO FLOWS OUT FAUCET 94. |
| $FS\bar{T}$ | ON | OFF | OFF | NO AIR FLOW THROUGH AIR HEATER. WATER FLOWS INTO SYSTEM THROUGH PIPE 92, CIRCULATES THROUGH HEAT EXCHANGER 14 AND FLOWS OUT OF THE FAUCET 94. |
| $FST$ | ON | ON | ON | AIR FLOW THROUGH AIR HEATER. WATER FLOWS IN PIPE 92. FLOWS THROUGH HEAT EXCHANGER 14, OUT FAUCET 94 AND THROUGH HEAT EXCHANGER 60 BACK INTO HEAT EXCHANGER 14. |

Fig. 3

UNIFIED HOT WATER AND FORCED AIR HEATING SYSTEM

BACKGROUND OF THE INVENTION

1. Field of the Invention

This invention relates generally to water heaters and to forced air furnaces, and more particularly to water heaters and forced air heaters combined together into a single functional unit.

2. Prior Art

Virtually every house, apartment, office building or other enclosure designed for prolonged human habitation is provided with both a means for supplying hot water and for maintaining air temperature at a comfortably warm level. Commonly, hot water is supplied by a self-contained water heater and air heating is provided by a forced air furnace.

Conventional water heaters and forced air heaters are relatively inefficient because a large portion of the heat energy which was to heat the water or forced air is lost to the surrounding environment. It is also wasteful to have a separate gas or other type burner for both the water heater and the air furnace if one would do. Furthermore, conventional water heaters are wasteful because when hot water is not being used, the hot water stored in the tank of the heater radiates heat to no useful purpose.

Because of these shortcomings, various individuals have developed combined water heating and air heating systems. For example, U.S. Pat. No. 3,833,170 discloses such a system including a liquid-to-gas heat exchanger unit disposed within an air plenum of a forced air heater so that when hot water from a water heater is circulated through the liquid-to-gas heat exchanger unit the air flowing through the plenum is heated.

U.S. Pat. No. 2,827,893 discloses a combined system for heating air and water which includes a plurality of gas-to-liquid heat exchange units used to remove heat from warm air flowing through a forced air furnace in order to warm the water within a hot water storage tank. Other, similar examples of combined air and water heaters are disclosed in U.S. Pat. Nos. 2,789,769 and 3,896,992.

A problem found with prior art combination water heater and air heater systems is that they only function at optimum efficiency under certain, specific conditions. For example, some systems will only produce hot water when the forced air heating system is on. This necessitates an additional or backup water heater for those times when hot water is desired and when the furnace is not turned on, for example, during all of the summer months.

Where hot water is used to heat forced air, as in other systems, another type of inefficiency can arise when the combined demand for hot water and heated forced air uses up all of the available hot water supply. In such a circumstance, neither hot water nor space heating would be available for the occupants of the building.

A further problem that the prior art does not address is how to provide both warm air and hot water rapidly and upon demand. In prior art systems, it takes a rather substantial period of time to heat water and/or air to a desired temperature if the hot water in the storage tank is exhausted.

The following U.S. Pat. Nos. disclose combined air and water systems or related heat recovery type systems: 2,373,731, 2,497,184, 3,198,190, 3,999,709, 4,037,786, 4,044,950 and 4,066,210.

SUMMARY OF THE INVENTION

A major object of this invention is to provide a combination water heater and forced air heater system that is simple in design and which works with greater fuel efficiency under a wide variety of demand conditions.

Another object of this invention is to provide a water heating and forced air heating system which can provide both hot water and heated air very rapidly even when the stored hot water supply is exhausted.

A combined hot water and forced air heating system has been devised which captures heat which is normally rejected in conventional water and air heating systems. A portion of the heat rejected from the gas flue of a water heater is combined with heat extracted from hot water itself to heat air for a forced hot air supply. Another portion of the heat rejected from the same gas flue is used to pre-heat cold or cooled water entering the system through a pipe coiled within the water heater. Three heat exchangers in this system, excluding the water heater itself, substantially increase the individual efficiencies of a hot water heater, or a forced air heater.

A first heat exchange unit comprises a coiled water pipe centrally disposed within the water heater near its burner inside of the heater flue. Some of the heated flue gas heats the coiled water pipe. Besides pre-heating cold or cool water in the water pipe, this heat exchanger provides an immediate source of hot water, even when the water heater supply is depleted, with the exchanger outflow being taken near the water heater hot water outflow port.

The second and third heat exchange units are disposed in heat transfer relation to a casing forming a forced air heating and compression region with an air inflow duct and an outflow duct. The second heat exchange unit is a liquid-to-gas unit for transferring heat from hot water flowing from the water heater to air in the casing. The third heat exchange unit is a gas-to-gas unit for capturing a portion of residual heat to be rejected by the gas flue and transferring that heat to air in the casing.

Two of these heat exchanges capture energy which would otherwise be heated, while the third obviates the need for a separate burner for forced air heating purposes, thereby aiding the energy conservation scheme of the present invention.

Another advantage of the present invention is that the gas-to-liquid heat exchange unit disposed within the exhaust flue of the water heater provides hot water very rapidly and, consequently, can very rapidly provide heated forced air.

BRIEF DESCRIPTION OF THE DRAWINGS

FIG. 3 is a logic table for operation of the system of FIG. 1, as controlled by the control unit shown in FIG. 2.

DESCRIPTION OF THE PREFERRED EMBODIMENT

Figure 1:
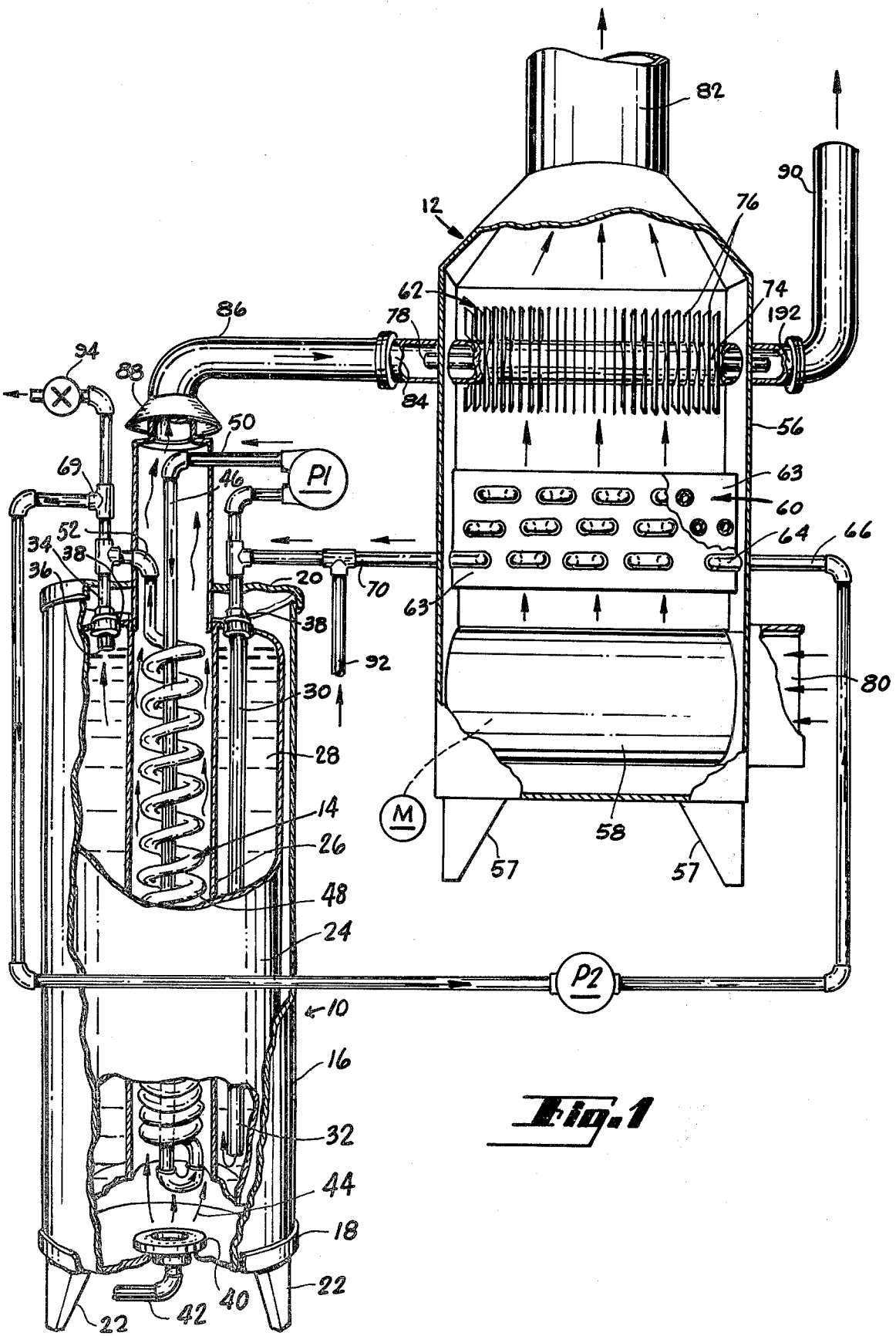
FIG. 1 is a partially cut away plan view of a water heater and forced air heating system in accord with the present invention.

Referring first to FIG. 1, a water heating and forced air heating system in accord with the present invention principally combines a hot water heater 10 and a forced air heater 12. The aforementioned assemblies are coupled together by a plurality of pipes, conduits, and pumps, as will be more fully discussed subsequently.

Water heater 10 includes a substantially cylindrical outer housing 16 having a lower cover 18 and an upper cover 20. Lower cover 18 is provided with a plurality of legs 22 for elevating the water heater slightly above its support surface.

Coaxially disposed within outer housing 16 is a closed, substantially cylindrical water tank 24 that has an axial vertical cylindrical passage opening on both ends thereof to form a water heater flue 26. The internal volume of the tank is usually substantially filled with water 28. Extending down nearly to the bottom of the tank is a pipe 30 having an end defining an inflow port 32. On the other side of the tank a short piece of pipe 34 extends into an upper portion of the tank and has an end which defines an outflow port 36. Pipes 30 and 34 are disposed through apertures formed through upper cover 20 and an upper end portion of tank 24 and are retained in position by pipe fasteners, such as those shown at 38.

Water 28 is heated by a burner 40 which is fed by a fuel feed line 42. The burner is attached to and extends through cover 18 in such a manner that it is disposed close to a lower end surface of tank 24. Burner 40 is usually of the natural gas or oilburning type which produces a clean, hot flame. Of course, other types of heating means are also suitable for heating the water in the tank, such as electrical resistance type heaters.

Flue 26 opens directly above the burner and serves to direct hot gases 44 away from the burner for eventual discharge. The gas-to-liquid heat exchange unit 14 formed by a pipe 46 in flue 26 is disposed within the flue to capture the heat of the gases flowing therethrough.

Heat exchange unit 14 basically comprises a straight section of pipe 46 which extends downwardly from the top of the flue almost to the burner and a spirally formed section of pipe 48 which spirals back up the flue. The free end of pipe section 46 defines an inflow end 50 and the free end of spiral pipe section 48 defines an outflow end 52. The outflow end of heat exchange unit 14 is coupled to pipe 34, and thus the outflow port 36, by connectors and short sections of pipe. The inflow end 50 of the heat exchange unit 14 is coupled to pipe 30 and thus to inflow port 32 by a water pump P1 and a similar plurality of connectors and short sections of pipe.

Forced air heater 12 includes an outer casing 56 provided with a plurality of legs 57 for spacing the forced air heater slightly above its supporting surface. The outer casing defines a chamber for housing a squirrel-cage blower 58, a liquid-to-gas heat exchange unit 60 and a gas-to-gas heat exchange unit 62. Liquid-to-gas heat exchange unit 60, shown here partially broken away for detail, includes a serpentine pattern of pipe 64 which loops back and forth between a pair of end plates 65. One end of pipe 64 defines a water inflow end 66 which is coupled to pipe 34 and thus the outflow port of the water heater by a pump P2, and a plurality of connectors and pipes. The other end of pipe 66 defines an outflow end 70 which is coupled to water heater pipe 30 and thus inflow port 32 by a plurality of connectors and short pipe sections.

Gas-to-gas heat exchange unit 62 comprises a cylindrical tube portion 74 to which is attached a plurality of heat radiating fins 76. Tube portion 74 is provided with a coaxial core 78 which functions to divert the flue gases to the peripheral surface of the tube portion in order to facilitate heat radiation of the gases.

Blower 58 is powered by a motor M so that it will draw fresh or recirculated air into the chamber through an intake duct 80, blow the air past heat exchange units 60 and 62 and then out of the chamber into a plenum or outflow duct 82 which leads to the forced air ducts of a dwelling or other building.

Coupling a gas inflow end 84 of heat exchanger 62 to the terminal end of flue 26 is a short tubular pipe section 86. A flue bonnet 88 is disposed over the end of flue 26 to provide for a better seal against escaping hot gases. A conduit 90 is attached to a gas outflow end 192 of the gas-to-gas heat exchange unit to finally vent the hot gases of the water heater to the outside environment.

To provide a water source for the hot water heater of the present invention, one end of a pipe 92 is coupled to the cold water system of the building and the other end is coupled to the water outflow end of heat exchange unit 60 and thus to pipe 30 and water heater inflow port 32. To draw hot water from the water heater, a faucet 94 is coupled to pipe 34 and thus to the water heater outflow port 36.

Figures 2, 4:
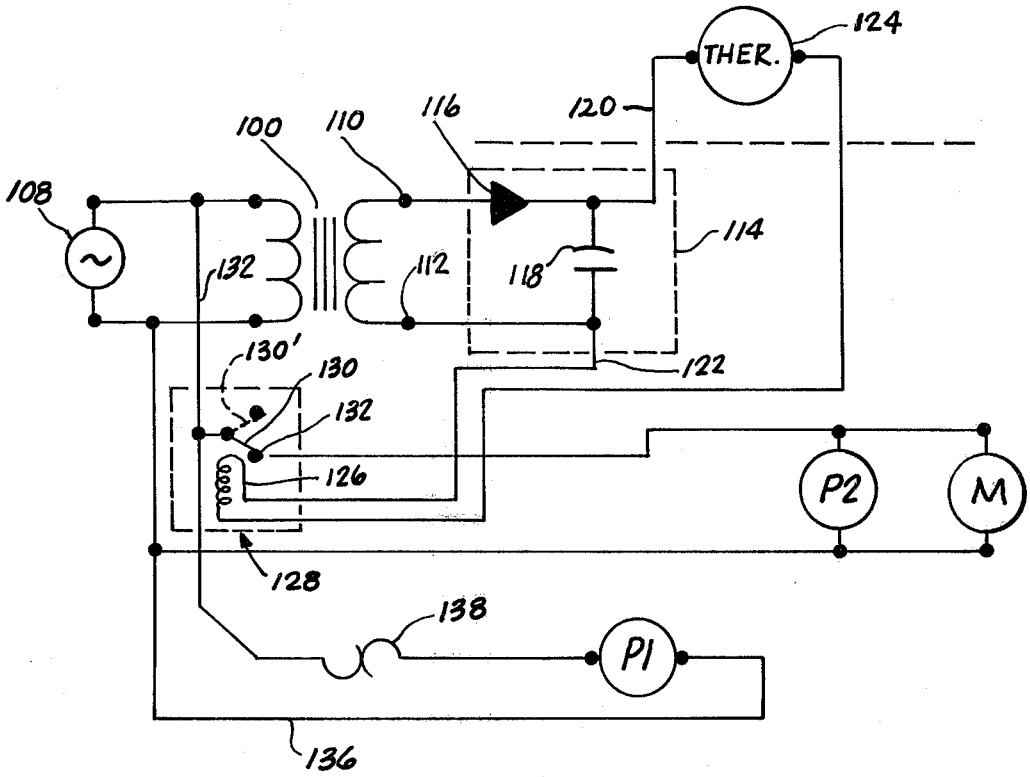
FIG. 2 illustrates a simple control unit for use with the system shown in FIG. 1.
FIG. 4 shows the legend for the logic table of FIG. 3.

Referring now to FIG. 2, a control circuit for controlling the operation of the combination water heating and forced air heating system includes a step-down transformer 100 having a pair of primary leads attached to the terminals of an a.c. power source 108 to provide a lower a.c. voltage between a pair of lines 110 and 112, nominally 24 volts a.c. The 24 volts a.c. is input into a half wave rectifier 114, which includes a diode 116 and a capacitor 118, to develop nominally 24 volts d.c. between lines 120 and 122. Coupled in series between lines 120 and 122 is a thermostat 124 and the coil 126 of a relay 128.

Thermostat 124 is generally of the adjustable bimetallic switch type which closes a pair of contacts when its surrounding temperature is below a certain predetermined temperature level and which opens the pair of contacts when the surrounding temperature is above that predetermined temperature level. The thermostat is generally located remotely from the rest of the control circuit, such as in a room or hallway of the building to be heated.

Thus, when the temperature sensed by thermostat 124 is below the predetermined temperature level, coil 126 is energized to pivot an armature 130 downwardly from a position shown at 130′ to touch a contact 132.

Pump P2 and motor M both have a first power input coupled to switch contact 132 and to both sides of a.c. supply 108. Consequently, when coil 126 is energized due to the closing of the pair of contacts within thermostat 124, armature 130 pivots downwardly to energize both pump P2 and motor M. As the contacts in thermostat 124 open, relay 128 is de-energized which allows armature 130 to pivot back to its position at 130′ to de-energize pump P2 and motor M.

Pump P1 has one of its power input terminals coupled to a.c. supply 108 by a thermal switch 138. The other power input terminal is coupled to the other side of the a.c. supply.

Thermal switch 138 is of the non adjustable bimetallic type which closes a pair of contacts when it is heated to a certain predetermined temperature level and which opens the contacts when its temperature falls below that predetermined temperature level. The switch is disposed in the exhaust flue of the water heater to sense when hot gases are flowing therethrough (i.e., the switch senses when burner 40 is on). When it does sense that the burner is on, the pair of contacts close to allow pump P1 to be energized and to pump water through the gas-to-liquid heat exchange unit.

Referring now to FIG. 3 of the drawing, a logic diagram is shown to help explain the operation of the present combined water heating and forced air heating system. The symbol legend of the logic table of FIG. 3 is shown in FIG. 4.

As seen in the logic table, when faucet 94 is closed, and switch 138 and thermostat 124 are open, all of the pumps and motors are turned off. No air flow through air heater 12 or water flow anywhere in the system is possible under these conditions.

When faucet 94 is closed, thermal switch 138 is open and the contacts of thermostat 124 are closed, pump P1 is off, pump P2 is on and motor M of the blower is on. Under these conditions, there is an air flow through the air heater and hot water is drawn from the hot water tank through outflow port 36, circulated through heat exchange unit 60 and returned to the tank through inflow port 32.

When the faucet is closed, the thermal switch is closed and the contacts of the thermostat are open, water is drawn from the tank by pump P1 through inflow port 32, circulated through heat exchanger 14 and returned to the tank through outflow port 36. There is no forced air flow through the forced air heater under these conditions. It should be remembered that when switch 138 is closed burner 40 is on because the water in tank 24 has cooled to such a degree that it needs to be reheated. Heat exchanger 14 of the present invention causes water 28 to be heated much more rapidly than it normally would be by trapping the heat of the hot gas byproducts of burner 40 before they escape up the flue. Also, heat exchanger 14 provides immediate hot water for a user should faucet 94 be subsequently opened or for the forced air heater should thermostat 124 suddenly close.

When the faucet, thermal switch and contacts of the thermostat are all closed, pump P1, pump P2 and motor M are all turned on. This causes tank water to be circulated through heat exchanger 14 to provide rapidly heated water to the system, heated water to be circulated through heat exchanger 60, and air to be moved through the forced air heater to pick up heat from both heat exchangers 60 and 62.

When faucet 94 is opened, thermal switch 138 is opened and the contacts of thermostat 124 are opened, water will flow out of the system for the first time through faucet 94. To replace the water flowing out of the system, water flows into the system through pipe 92 from the cold water source of the building. More specifically, when faucet 94 is opened, water will flow through pipe 92, into the water heater through inflow port 32, out of the water heater through outflow port 36 and out of faucet 94. Under these conditions, the system of the present invention operates substantially as a conventional water heater.

When faucet 94 is open, thermal switch 138 is open, and the contacts of thermostat 124 are closed, pump P1 is off, pump P2 is on and motor M is on. Under these conditions, some of the tank water flows out of faucet 94 and some other of the tank water flows through heat exchanger 60 and returns to the water tank. Air flows through the forced air heater to pick up heat from both heat exchange units 60 and 62.

When the faucet is open, the thermal switch is closed and the contacts of thermostats 124 are open, pump P1 is on and the other pump and the exhaust motor are off. Under these conditions, water flows into the system through pipe 92, is pumped through heat exchanger 14 and flows out of the system through faucet 94. Thus, in the manner explained above, heat exchanger 14 provides instant hot water for a user even though the water stored in tank 24 is insufficiently warm.

Finally, when faucet 94 is open, thermal switch 138 closed and the contacts of thermostat 124 are closed, water flows into the system through pipe 92, is circulated through heat exchange unit 14 by pump P1 and flows both out faucet 94 and through heat exchange unit 60. The portion of the water flowing through heat exchange unit 60 is then returned to the inflow of heat exchange unit 14. Air is moved through forced air heater 12 to pick up heat from heat exchangers 60 and 62.

Of course, the actual flow of the water within the system is quite complex and has been discussed in a simplified fashion for the purpose of illustration. For instance, in the last set of conditions discussed above it is possible that some of the water flowing in pipe 92 will flow out inflow port 32 and into tank 24 rather then being pumped by pump P1 through heat exchanger 14. However, the water flow can be controlled to be substantially as described above.

While this invention has been described in terms of a single preferred embodiment, it is contemplated that various alterations and modifications thereof will become apparent after having read the preceding detailed description. For example, it should be apparent that components of the present system can comprise a retrofit kit for modifying a conventional water heater similar in design to the water heater 10 of the present invention. Furthermore, heat exchange unit 14 could comprise a retrofit unit by itself for modifying a suitable water heater to provide for more rapid water heating than would otherwise be possible.

With regard to the water heater disclosed herein, the gas-to-liquid heat exchanger which is disposed in the central gas flue has a low liquid capacity for water, compared to the capacity of the hot water tank. For example, for a 40-gallon hot water tank, the capacity of the gas-to-liquid heat exchanger which is the coil pipe within the central flue of the water heater may be two to five gallons, although these values are not critical. However, in order that the water heater have a fast starting capability, the energy expended by the burner must rapidly heat a small supply of water which is made immediately available.

This gas-to-liquid heat exchanger may be thought of as a second, low capacity water heater which shares the same burner with the larger water heater and which is connected in parallel to the hot water outflow and the cool water inflow of the tank. This system of parallel water heaters provides very fast heating of the low capacity supply which is important when the large main tank is depleted of hot water or if the burner has been turned off for a relatively long time.

What is claimed is:

1. A water heating and forced air heating system, the combination comprising:

a water heater including a water tank substantially filled with water and having an inflow port and an outflow port, heating means for heating the water contained by said tank, and water heater exhaust flue means for removing hot gases generated by said heating means;

a gas-to-liquid heat exchange unit disposed within said exhaust flue means and having a first water inflow end and a first water outflow end, said first water outflow end being coupled to said outflow port, whereby water flowing through said gas-to-liquid heat exchange unit is heated by the hot gases within said flue;

a forced air heater including a casing means having an inflow duct and an outflow duct and defining an air chamber, a liquid-to-gas heat exchange unit disposed within said chamber and having a second water inflow end and a second water outflow end, a gas-to-gas heat exchange unit disposed within said chamber and having a gas inflow end and a gas outflow end, and blower means for moving air through said inflow duct into said chamber, past said liquid-to-gas heat exchange unit and said gas-to-gas heat exchange unit and out said outflow duct;

a first pump means coupling said inflow port to said first water inflow end to pump water into said first water inflow end;

a second pump means coupling said outflow port to said second water inflow end to pump water into said second water inflow end;

means coupling both said inflow port and said second water outflow end to a source of pressurized water; and means connecting the terminal end of said water heater exhaust flue means to said gas inflow and;

whereby said air flowing through said chamber and out said outflow duct is heated by the hot water flowing through said liquid-to-gas heat exchange unit from said hot water heater and by the hot gases flowing through said gas-to-gas heat exchange unit from said exhaust flue and whereby hot water is always present at said outflow port due to rapid water heating by said gas-to-liquid heat exchange unit.

2. A water heating and forced air heating system as recited in claim 1 further comprising:

a first control means responsive to the ambient temperature of an enclosed space and operative to energize said second pump means and said exhaust means when said ambient temperature is below a first predetermined temperature level.

3. A water heating and forced air heating system as recited in claim 2 wherein said first control means includes:

a power source, a thermostat responsive to said ambient temperature and operative to produce a relay actuating signal whenever said ambient temperature falls below said first temperature level, and relay means responsive to said relay actuating signal and operative to couple both said second pump means and said exhaust means to said power source.

4. A water heating and forced air heating system as recited in claim 2 further comprising:

a second control means responsive to the temperature of said gases within said flue and operative to energize said first pump means when the temperature of said gases exceeds a second predetermined temperature level.

5. A water heating and forced air heating system as recited in claim 4 wherein said second control means includes:

a power source, and a thermal switch coupling said first pump means to said power source, where said thermal switch is open when the temperature of said gases is below said second predetermined temperature level and said thermal switch is closed when the temperature of said gases is above said second predetermined temperature level.

6. A forced air heating system comprising:

a gas-to-liquid heat exchange unit disposed within an exhaust flue of a water heater of the type having an inflow port, an outflow port and a hot gas exhaust flue, said heat exchange unit having a water inflow end and a water outflow end, said water outflow end being coupled to said water heater outflow port, whereby water flowing through said gas-to-liquid heat exchange unit is heated by hot gas within said flue;

a forced air heater including a casing means having an inflow duct and an outflow duct and defining an air chamber, a liquid-to-gas heat exchange unit disposed within said chamber and having a water inflow end and a water outflow end, a gas-to-gas heat exchange unit disposed within said chamber and having a gas inflow end and a gas outflow end, and blower means for moving air through said inflow duct into said chamber, past said liquid-to-gas heat exchange unit and said gas-to-gas heat exchange unit and out said outflow duct;

a first pump means coupling said inflow port to said first water inflow end to pump water into said first water inflow end;

a second pump means coupling said outflow port to said second water inflow end to pump water into said second water inflow end;

means coupling both said inflow port and said second water outflow end to a source of pressurized water; and means connecting the terminal end of said exhaust flue to said gas inflow end;

whereby said air flowing through said chamber and out said outflow duct is heated by the hot water flowing through said liquid-to-gas heat exchange unit from said water heater and by the hot gases flowing through said gas-to-gas heat exchange unit from said exhaust flue and whereby hot water is always present at said outflow port due to the rapid heating of the water within said gas-to-liquid heat exchange unit.

7. A forced air heating system as recited in claim 6 further comprising:

a first control means responsive to the ambient temperature of an enclosed space and operative to energize said second pump means and said exhaust means when said ambient temperature is below a first predetermined temperature level.

8. A forced air heating system as recited in claim 7 wherein said first control means includes:

a power source, a thermostat responsive to said ambient temperature and operative to produce a relay actuating signal whenever said ambient temperature falls below said first temperature level, and relay means responsive to said relay actuating signal and operative to couple both said second pump means and said exhaust means to said power source.

9. A forced air heating system as recited in claims 6 or 7 further comprising a second control means responsive to the temperature within said flue and operative to energize said first pump means when the temperature exceeds a second predetermined temperature level.

10. A forced air heating system as recited in claim 9 wherein said second control means includes:

a power source, and a thermal switch coupling said first pump means to said power source where said thermal switch is open when the temperature of said gases is below said second temperature level and said thermal switch is closed when the temperature of said gases is above said second temperature level.

11. A forced air heating system as recited in claim 6 wherein said output duct is coupled to the air duct system of a building.

12. A forced air heating system as recited in claim 6 wherein said gas-to-gas heat exchange unit is provided with a central core to force the hot gases flowing therethrough against its outer peripheral surface.

* * * * *